US006076199A

United States Patent [19]

Na

[11] Patent Number: 6,076,199

[45] Date of Patent: Jun. 20, 2000

[54] FLUSH TANK LID CONCEALING A CLEANSING DEVICE

[76] Inventor: Jang Ju Na, 123 S. Catalina St. #110, Los Angeles, Calif. 90004

[21] Appl. No.: 09/208,560

[22] Filed: Dec. 9, 1998

[51] Int. Cl.[7] ..... A47K 3/20

[52] U.S. Cl. ..... 4/420.4

[58] Field of Search ..... 4/420.1–420.5, 4/443–448, 353, 664, 665

[56] References Cited

U.S. PATENT DOCUMENTS

| | | | |
|---|---|---|---|
| 1,935,779 | 11/1933 | Kemach | 4/665 |
| 3,015,827 | 1/1962 | Iwata | 4/664 X |
| 3,090,965 | 5/1963 | Panza | 4/420.1 X |
| 4,206,520 | 6/1980 | Fulford | 4/665 |
| 5,228,152 | 7/1993 | Fraley | 4/664 |
| 5,564,134 | 10/1996 | Ruth | 4/233 |
| 5,754,988 | 5/1998 | Presa | 4/420.2 X |

*Primary Examiner*—Charles E. Phillips
*Attorney, Agent, or Firm*—Joseph E. Mueth

[57] ABSTRACT

An independent flush tank lid with cleansing device concealing a device for wetting toilet tissues as well as means for cleansing a person's body parts which replaces the existing flush tank lid without any modification or any mounting to existing toilet or bathroom wall. The lid comprises a sink including a faucet assembly associated with hot and cold water supply, a water extension hose having a spray nozzle to enable a person to use the spray of water at the sink, at the toilet bowl, or at an adjacent bathroom sink. The flush tank lid with cleansing device is neat in appearance and constructed with a base container having a sink and a compartment for storing an extension hose therein in the bottom and a cover plate at the top.

8 Claims, 3 Drawing Sheets

FLUSH TANK LID CONCEALING A CLEANSING DEVICE

FIELD OF INVENTION

The present invention relates to a flush tank lid for a toilet, more particularly to an independent and removable flush tank lid which conceals a device for wetting toilet tissues and cleansing a user's body parts.

BACKGROUND AND OBJECTS OF INVENTION

Although various types of bidets for cleansing a user's body parts and devices for wetting toilet tissues have been known for many years, the use of such devices have not become well established in most homes.

Among the common disadvantages of bidets are that they are complex to assemble, require alterations to a toilet, and involve considerable expense of installation. While some of bidets and toilet tissue wetting devices are satisfactory, many such devices are not attractive in visual appearance.

Most persons prefer to maintain their personal hygiene in private. Therefore, having a device for cleansing private body parts at the toilet which can be seen by the other person may result in embarrassment to the user.

This invention seeks to overcome above mentioned disadvantages by enabling a user to simply connect to the water supply and replace the existing flush tank lid without the need for any mounting to toilet fixtures or to a bathroom wall, or alteration of the toilet fixture. The present invention can be manufactured to provide the neat appearance of the usual flush tank lid while concealing the cleansing device therein.

The present invention takes the form of a flush tank lid which includes a device for wetting toilet tissues, a device for cleansing private body parts, and an extra water hose extension with spray nozzle for washing the head or feet by removing and extending the extension hose with spray nozzle to a nearby bathroom sink.

Furthermore, the present invention, unlike bidets, allows a user to manually control the quantity of flowing water and carry the spray nozzle to any desired point, thereby preventing the emission of water at an unintended location.

The flush tank lid of the present invention is adapted to replace the existing flush tank lid as long as the bottom dimension thereof is greater than the top dimension of the existing flush tank. The present invention may be manufactured with or without the cover plate, and provided as a lid for a new flush tank or it can be sold as a separate item.

Further objects or advantages of the invention will become apparent from consideration of the drawings and the ensuing description thereof.

BRIEF DESCRIPTION OF DRAWINGS

In the drawings, closely related figures have the same numbers but different alphabetic suffixes.

DETAILED DESCRIPTION OF THE PREFERRED EMBODIMENT

Figure 1:
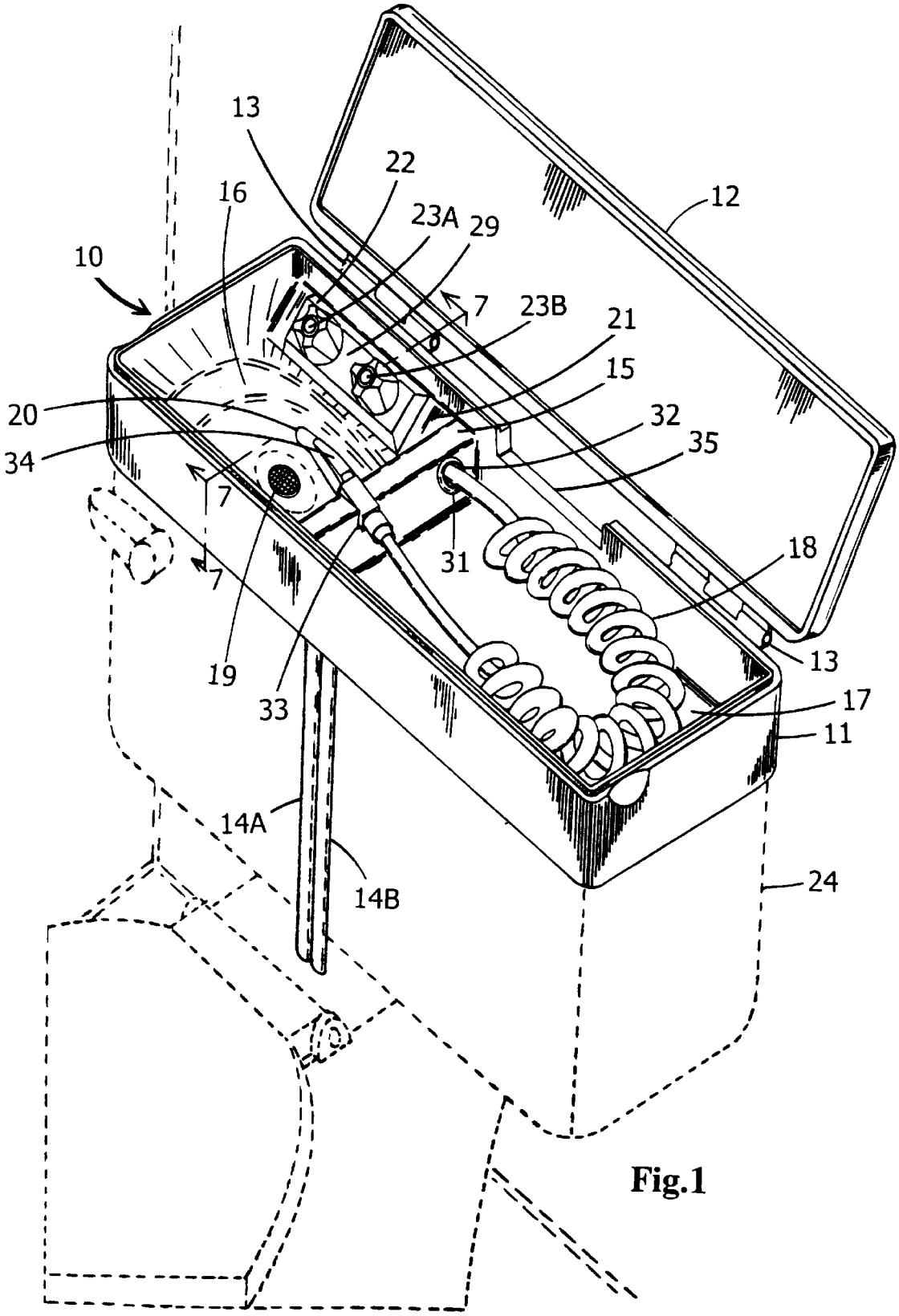
FIG. 1 is a top perspective view of the toilet flush tank lid of this invention concealing a cleansing device in which a section of toilet bowl adjacent the bathroom wall is shown in dotted lines.

The present invention provides the flush tank lid with a cleansing device 10 comprising a base container 11 and a cover plate 12 mounted by a transverse hinge 13, having domestic hot and cold water supply 14A and 14B, and water discharge system, all associated with a common flush tank type of toilet system as illustrated in FIG. 1.

Figure 2:
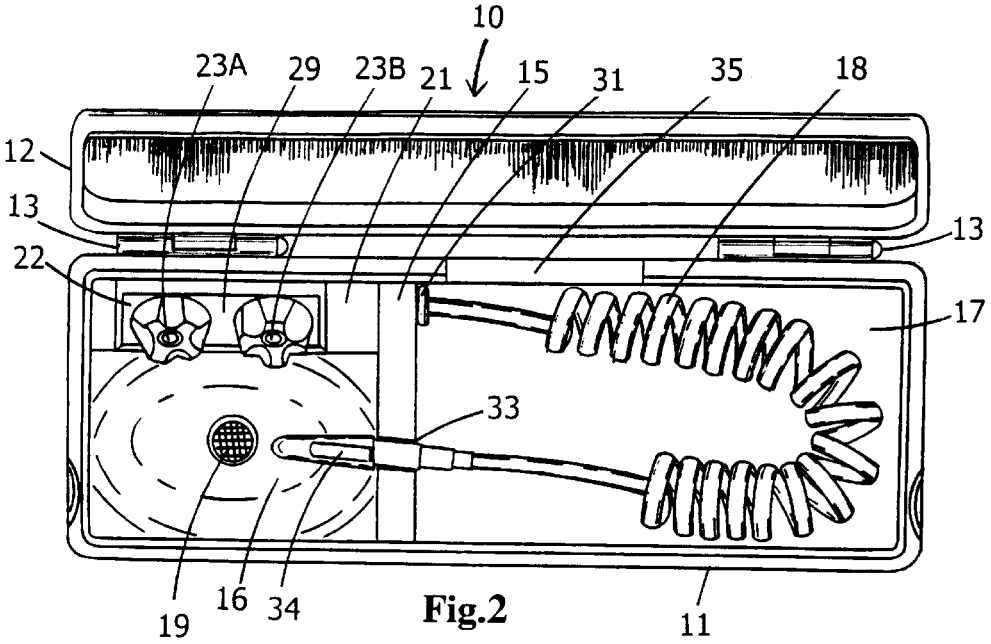
FIG. 2 is a top view of FIG. 1, in which the cover plate of the flush tank lid is opened substantially upright.
Figure 3:
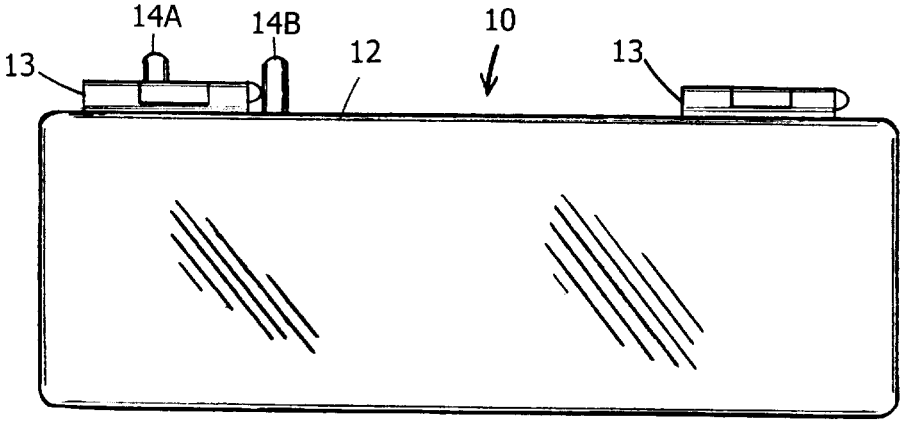
FIG. 3 is a top view of FIG. 1, in which the cover plate is closed.
Figure 4:
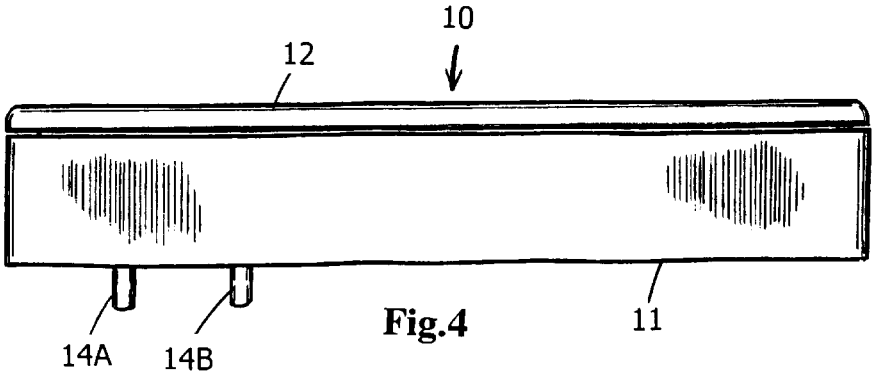
FIG. 4 is a front view of FIG. 1, in which the cover plate is closed.

The base container 11 and the cover plate 12 are preferably made from a rigid plastic material. FIG. 1 and FIG. 2 shows that the base container 11 is a tray-like structure having two compartments which are horizontally adjacent to one another and separated by a partition wall 15 formed vertically between front and rear walls.

The first compartment of the base container 11 forms a sink 16, and the second compartment forms a chamber 17 for housing a water hose extension 18 as shown in FIG. 1 and FIG. 2.

Figure 8:
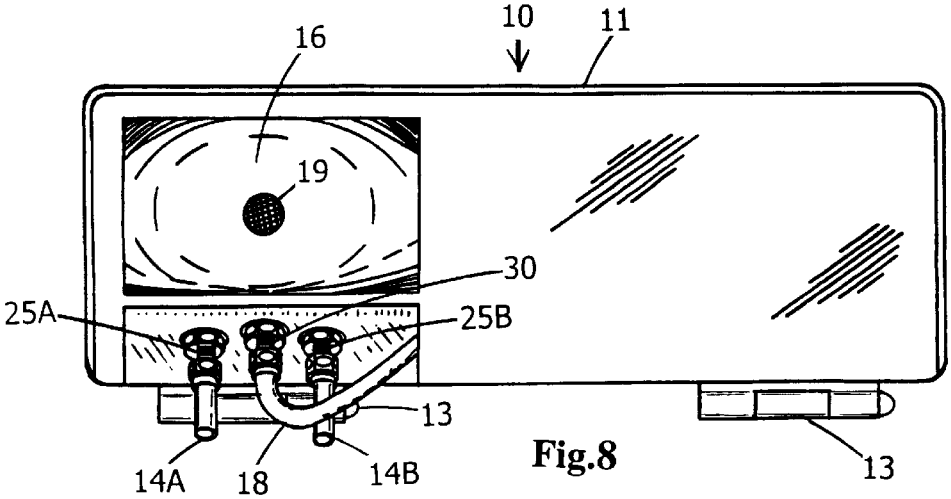
FIG. 8 is a bottom view of the FIG. 1 in which the cover plate is closed.

The bottom of the base container 11 is adopted to be placed on the top of a toilet flush tank and dimensioned so as to fit most of existing flush tanks as shown in FIG. 8.

Figure 7:
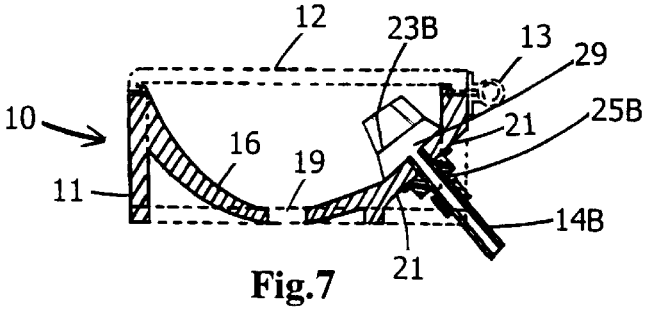
FIG. 7 is a vertical, cross-sectional view of FIG. 1 taken on the line 7—7 thereon, in which the cover plate shown in dotted lines is closed.

As shown in FIG. 1 and FIG. 7, the floor of the sink 16 slopes to the center, whereby the drain hole 19 is provided to discharge water into the open flush tank.

The depth of sink 16 is sufficient to collect splash, the rinsing of hands, and for holding toilet tissues below the spray nozzle 20.

Figure 6:
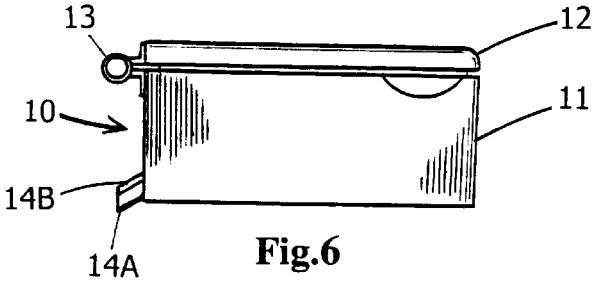
FIG. 6 is a side view of FIG. 1, in which the cover plate is closed.

FIG. 1 and FIG. 7 show the rear wall of sink 16 sloping with a diagonal angle frontwardly and downwardly to form a counter top 21 which extends along the adjoining rear wall of base container 11 for a faucet assembly 22 to be installed therein. The tops of faucet handles 23A and 23B extend frontwardly and upwardly, so the rear ends of faucet assembly 22 do not disturb the top rim of the flush tank 24 that extends downwardly and rearwardly into the space behind the flush tank as shown in FIG. 1, FIG. 6 and FIG. 7.

Figure 5:
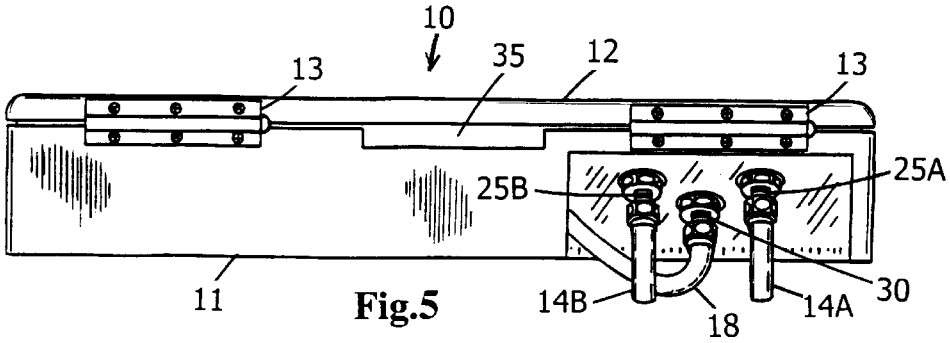
FIG. 5 is a rear view of FIG. 1, in which the cover plate is closed.

The faucet assembly 22 is mounted in a known manner at a perpendicular angle to counter top 21 and is provided with hot and cold water inlets 25A and 25B which are associated with flexible hot and cold water supply tubes 14A and 14B for supplying pressurized water from adjacent domestic water valves as shown in FIG. 5, FIG. 7, and FIG. 8.

Two manually operated faucet handles 23A and 23B control valves (not shown) which are mounted in faucet body 29, to provide for the mixture of hot and cold water flow through the outlet 30 protruding from lower middle portion of faucet body 29. The extension hose 18 attached to outlet 30 extends downwardly and rearwardly below the counter top 21 as illustrated in FIG. 8

The outlet 30 attached to a water extension hose 18 is made from a resilient material in the shape of a coil spring.

Extension hose 18 attached to outlet 30 extends toward chamber 17, and passes through the opening hole 32 formed in the partition wall 15. The extension hose 18 is secured by the flexible O-ring 31, and positioned on the floor of chamber 17 in the shape of an oval or circle leading the end thereof toward the slot 33.

Extension hose 18 further includes a spray nozzle 20 equipped with a valve switch 34 for controlling the flow of water.

As shown in FIG. 1, spray nozzle 20 is placed in the inverted U-shaped slot 33 formed at the upper middle portion of partition wall 15.

The body of spray nozzle 20 is so shaped and configured as to be snuggly received within slot 33.

Spray nozzle 20 is designed to interrupt the flow of water when the on/off valve switch 34 is depressed. The spray nozzle 20 can be appropriately spaced above the floor of sink 16 and extended over the center of sink 16, so that water can be directed downwardly toward the center of sink 16.

FIG. 1 and FIG. 5 show that the rear wall of container 11 is provided with a substantially long inverted slot 35 at the upper middle portion thereof to allow air ventilation therethrough to keep the interior dry. In use, a user may open the cover plate 12 and turn on handles 23A and 23B for any desired mixture of water to flow into the sink 16 through extension hose 18 and spray nozzle 20. The water spray can be used at either sink 16 by holding toilet tissues below the spray nozzle 20, or at a toilet bowl, or at an adjacent bathroom sink by removing spray nozzle 20 from slot 34 and extending extension hose 18 to the desired position over the adjacent sink.

Although the description above contains many specifities, these should not be construed as limiting the scope of the invention but as merely providing illustrations of some of the presently preferred embodiments of this invention.

Thus, the scope of the invention should be determined by the appended claims and their legal equivalents, rather than by the examples given.

What I claim as my invention is:

1. A lid for covering the open top of a toilet flush tank, said lid having a devices mounted therein for wetting toilet tissues as well as cleansing body parts of a person, said lid formed as an entirely independent unit without any attachment to said flush tank or adjacent bathroom wall so that said lid may be removed without any disturbance from said flush tank or said adjacent bathroom wall, said lid comprising:

a tray-like container having a bottom adapted to be placed on the open top of said flush tank, and substantially upstanding front, rear, and side walls having predetermined heights;

a sink formed at one portion of said container comprising an open hold for draining away water into said open flush tank;

a manually operative faucet means, including a body, being mounted to said sink, said faucet means including a flexible inlet means for supplying pressurized water from a water supply means positioned adjacent to said toilet into an interior of said faucet means and an outlet means mounted to said body of said faucet means for discharging water therethrough;

a flexible water hose extension means connected to said outlet means and being capable of extending to the bowl of said toilet or to an adjacent bathroom sink, said water hose extension means provided with a spray means equipped with a manually operative valve means mounted in the body of said spray means to control the flow of water therethrough;

a chamber formed at the remaining portion of said container for storing therein said water hose extension means, when said water hose extension means is not needed; and a partition wall vertically positioned between said front and rear walls of said container for dividing said container into said sink and chamber.

2. The lid for covering the open top of a toilet flush tank of claim 1, wherein said container includes a cover plate hingedly mounted to the top of the rear wall of said container for opening and closing said open top of said container to provide access to the interior of said container and to remove said cleansing device therefrom.

3. A lid for covering the open top of a toilet flush tank of claim 1, wherein said sink includes a counter top formed diagonally along the adjoining rear wall of said container.

4. A lid for covering the open top of toilet flush tank of claim 1, wherein said faucet means communicates with hot and cold water supply means.

5. A lid for covering the open top of toilet flush tank of claim 1, wherein said faucet means includes handles for operating said faucet means, said faucet means being mounted on said counter top at a perpendicular angle so that tops of said handles extend frontwardly and upwardly.

6. A lid for covering the open top of toilet flush tank of claim 1, wherein said outlet means protrudes downwardly and rearwardly from the lower middle portion of the body of said faucet means, so that said outlet means extends behind and below said counter top.

7. A lid for covering the open top of toilet flush tank of claim 1, wherein said partition wall is provided with an inverted U-shaped slot at the upper middle portion thereof for snuggly receiving therein the body of said spray nozzle.

8. A lid for covering the open top of toilet flush tank of claim 1, wherein said flexible water hose extension means is in the shape of a coil spring.

* * * * *